US005991362A

United States Patent [19]

Jones

[11] Patent Number: 5,991,362

[45] Date of Patent: Nov. 23, 1999

[54] ADJUSTABLE OPENING X-RAY MASK

[75] Inventor: Mark R. Jones, Reading, Mass.

[73] Assignee: XRE Corporation, Littleton, Mass.

[21] Appl. No.: 08/752,651

[22] Filed: Nov. 15, 1996

[51] Int. Cl.[6] ..... G21K 1/04

[52] U.S. Cl. ..... 378/152; 378/150

[58] Field of Search ..... 378/147–153, 378/156–160

[56] References Cited

U.S. PATENT DOCUMENTS

| | | | |
|---|---|---|---|
| 3,115,580 | 12/1963 | Brewer | 378/152 |
| 4,752,947 | 6/1988 | Telorack | 378/152 |
| 5,086,444 | 2/1992 | Bartmann | 378/152 |
| 5,689,544 | 11/1997 | Besselaar | 378/150 |

*Primary Examiner*—David P. Porta

*Attorney, Agent, or Firm*—Donald S. Holland, Esq.; Holland & Bonzagni, P.C.

[57] ABSTRACT

A controller of the cross sectional area and shape of an X-ray beam includes two or more disks disposed in the center of the path of the beam, each disk being radio-opaque except for a window centered on the beam. One or more of the disks has a tracks at each side of the window in which shutters can slide between positions in which they close or open the window and select the size and shape of the X-ray beam passed through the controller and a subject to an image intensifier or other X-ray utilization device. One of the disks has a cam track which is engaged by a cam following element attached to a shutter on the other disk. The disks are mounted for relative rotation by drive motors which causes the shutter with the cam follower to change position and alter the size or shape of the transmitted beam cross section. With the shutter in desired position the disks can be rotated together to reorient the shaped beam around its central axis.

22 Claims, 2 Drawing Sheets

ADJUSTABLE OPENING X-RAY MASK

BACKGROUND OF THE INVENTION

A conventional X-ray tube emits a cone-shaped beam far wider than necessary to expose a limited area of a patient. It is therefore usual to control the cross sectional area of the beam radiated through the patient position by use of an X-ray attenuating mask or controller. Such controllers are sometimes called collimators although they do not collimate a beam into parallel rays. Masks of lead will substantially attenuate all X-radiation except through an X-ray transmissive window located on the central axis of the X-ray beam; a mask of aluminum will only partially attenutate the intensity of an X-ray, but is useful in subduing overly bright areas of an X-ray image. The more usual lead masks controllers are necessarily heavy and difficult to incorporate into a simple mechanism, accurately and repeatably adjusting the cross sectional size and shape of the transmitted beam. Prior controller mechanism are also bulky obstructing operations around the patient.

It is the object of the present invention to provide a simplified X-ray controller mechanism, with a minimal weight, which can define X-ray openings of variable shapes, sizes and orientation of a shaped opening with regard to the patient.

SUMMARY OF THE INVENTION

According to the invention an X-ray beam controller is located in the X-ray beam between its source and X-ray utilization means such as a film holder. The controller comprises two superimposed disks, each having an X-ray window on the central axis of the beam and each able to rotate about that axis. One of the disks has a track for a two part shutter of X-ray attenuating metal such as lead or tin. The shutter has a pin projecting into a curved cam slot in the other of the disks. When the disks are rotated relative to each other, the shutter is caused by the cam linkage of pin and slot to slide between open and closed positions forming an X-ray window. By rotating the two disks together the shaped opening is rotated about the central axis.

DETAILED DESCRIPTION OF THE PREFERRED EMBODIMENT

Figure 1:
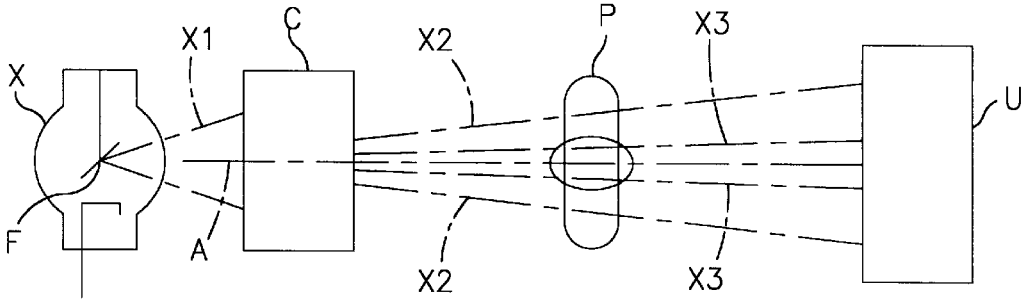
FIG. 1 is an optical diagram of the an X-ray system with a controller according to the invention.

The X-ray system shown in FIG. 1 comprises an X-ray tube X radiating a beam X1 from a focal point F on a central axis A through a beam controller C and a patient position P to a film holder, image intensifier or other X-ray utilization means U. The greatest angular width of the X-ray beam X1 is between the focal point F and controller C. The controller reduces the angular width at least to a full size X2 which strikes only the film holder U. Adjustment of the controller further reduces the beam to a narrow width X3 transmitted through a very limited area of the patient, and subjecting him to minimal X-ray exposure. If needed the beam can be reduced to zero width.

Figure 2:
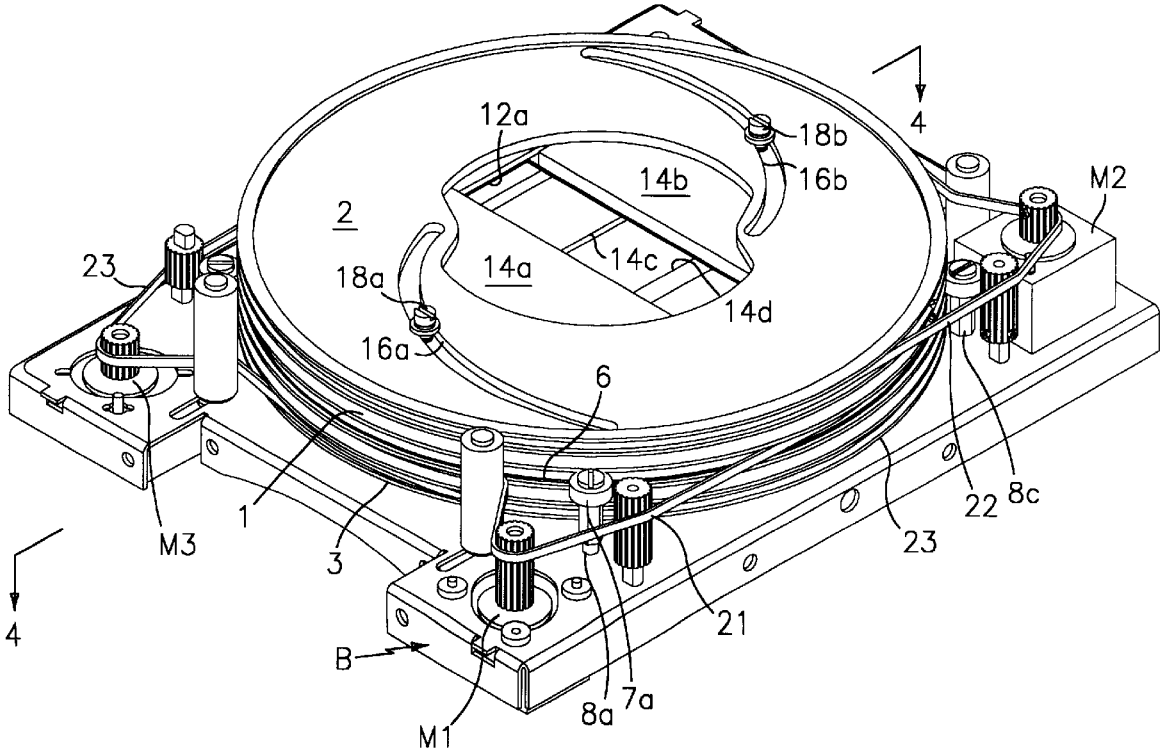
FIG. 2 is an isometric view of the controller.
Figure 3:
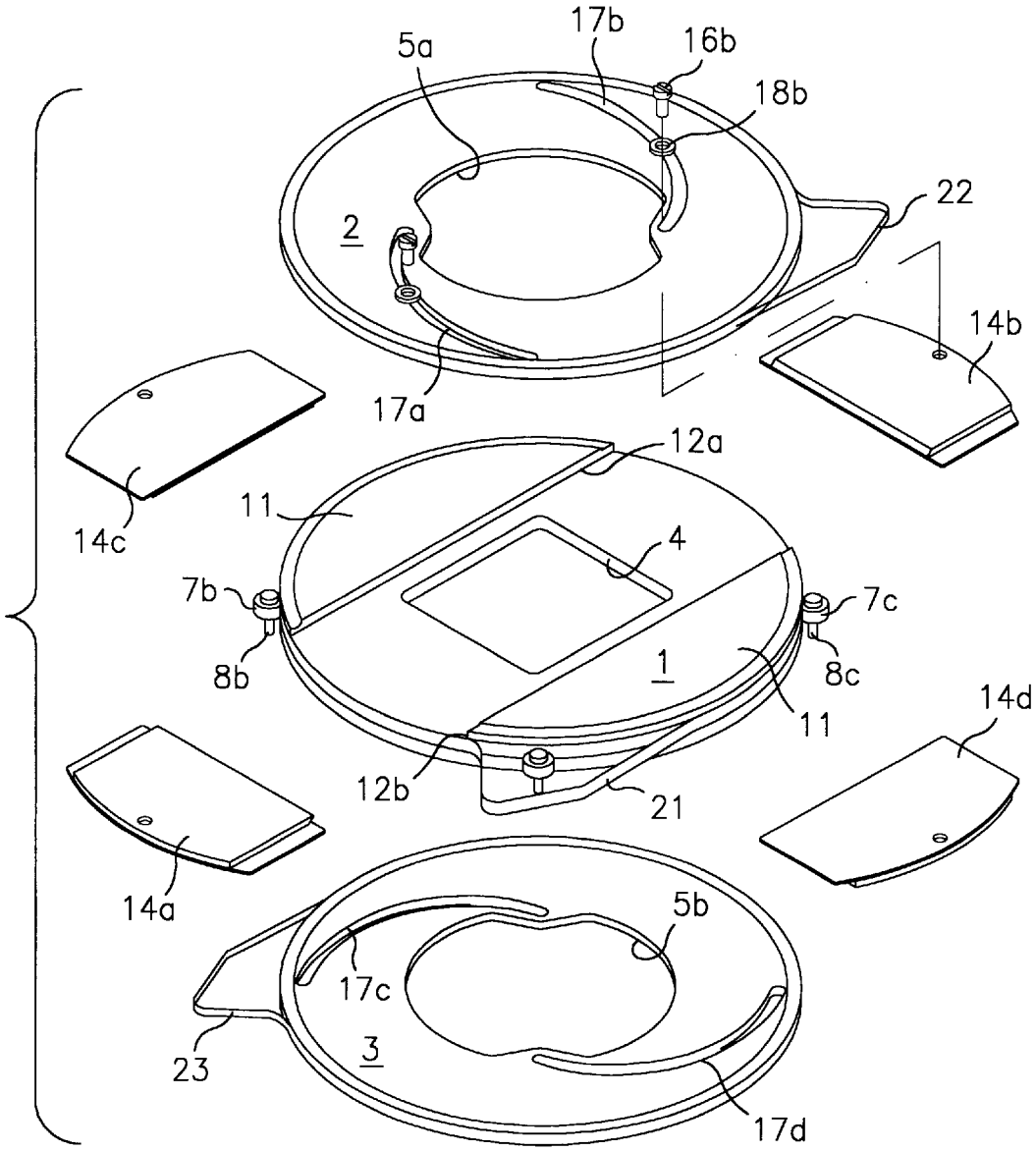
FIG. 3 is an exploded view of the controller.
Figure 4:
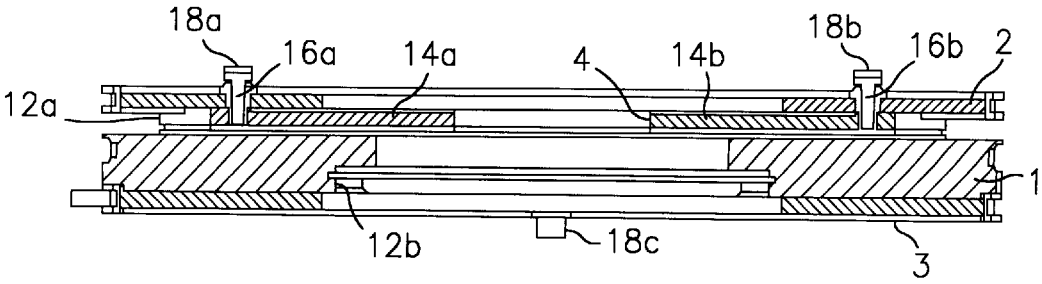
FIG. 4 is a vertical section through plane 4—4 of FIG. 3.

The structure of the controller shown in FIGS. 2–4 includes a base B supporting three circular disks, a middle disk 1, an upper disk 2, and a lower disk 3. The middle disk has a rectangular X-ray window 4, and the upper and lower disks each have an irregular X-ray window 5*a*, 5*b* on the central X-ray axis A, which is also the geometric axis of the three disks. The middle disk has a circumferential groove 6 receiving four wheels (e.g., 7*a*, 7*b*, 7*c*) rotating at the upper end of studs (e.g., 8*a*, 8*b*, 8*c*). The studs are set in the base B at four locations around the first, middle disk and support the middle disk on the base. The upper and under surfaces of the middle disk 1 have identical circular circumferential bearing faces of which the upper faces (e.g., 11) are shown in FIG. 3. The upper disk 2 is supported on face 11 of mid-disk 1. The under faces of the middle disk bear on the lower disk 3.

Across its upper and lower sides the middle disk 1 has a set of tracks formed by undercut straight grooves 12*a*, 12*b* at opposite sides of the window. Fitting in each track is a pair of shutter plates 14*a*, 14*b*, 14*c*, 14*d* which can slide in the track toward and from the central axis from an open position shown in FIGS. 2 and 4 to a closed position in which they meet at the central axis A and close the X-ray window 4 in the middle disk 1. Projecting upwardly from the shutter plates 14*a*, 14*b* sliding on the upper side of the middle disk 1, and downwardly from the plates 14*c*, 14*d* on the underside of the middle disk 1 are pins 16*a*, 16*b*, 16*c*, 16*d* which pass through symmetrical pairs of arcuate cam slots 17*a*, 17*b*, 17*c*, 17*d* cut through the upper and lower disks 2 and 3. These pins have enlarged heads 18*a*, 18*b*, 18*c* which hold the upper and lower disks against the opposed bearing faces (e.g., 11) on the upper and under sides of the middle disk 1.

The primary function of the interengaged pin and slot elements is to adjust the shutter plates and the opening between them when the middle disk 1 is rotated relative to the upper or lower disks. Rotation of the disks 1, 2, 3 is effected by rotational means, such as the illustrated three stepping motors M1, M2 and M3 linked to the three disks respectively by drive belts 21, 22 and 23 engaging the peripheries of the respective disks. The motors are turned for brief periods until a desired adjustment of the shutter opening is obtained. The curve of the cam slot is a linear function of the increase in radius of loci on the curve in relation to angular change. For example, 0.02 times the angular change in degrees yields the distance of shutter movement in inches.

When the first motor does not turn but the second motor M2 rotates the upper disk relative to the middle disk 1, the pins 16*a*, 16*b* in the upper cam slots 17*a*, 17*b* are displaced radially of the upper disk and drive their respective shutter plates 14*a*, 14*b* to or from the central axis A to open or close the upper shutters and vary one cross sectional dimension of the X-ray beam passing through. The other dimension remains unchanged because the lower plate 3 has not rotated relative to the middle plate 1. But, when the third motor M3 turns at the same time as the second motor, the lower set of shutters 14*c*, 14*d* will slide on the underside of the middle disk and vary the cross sectional beam dimension at right angles to the other dimension. If the opposed edges of the shutter plates are straight, these adjustments vary the rectangular shape of the disk opening. Other shaped openings may be formed by providing curved shutter edges. With a desired shape and size of opening obtained that shape may be oriented about the central axis by turning the first motor M3 and rotating all three disks together. The peripheral, belt drive of the disks, particularly the middle disk 1, allows orientation of the selected opening through 360 degrees and continuously beyond.

In other words, not only can the shutter plates 14*a*, 14*b*, 14*c*, 14*d* selectively vary the size of the X-ray beam X1 passing through their respective openings, the disks 1, 2, 3 can also be selectively rotated to reposition or spin the rectangular beam projected through the collimation C, along the beam's central axis. For example, a patient looking up at the rectangular opening in the collimator might first view that opening as a square and later reoriented as a diamond. It could also be viewed as having increased or decreased in size. These results are accomplished by the irregular disk openings 5*a*, 5*b* (illustrated as being kidney-shaped in the preferred embodiment) cooperating with the two sets of shutters.

In some case the volume in a patient under examination my contain portions considerably less dense and less absorptive of X-rays than a portion under consideration. In that case the less dense portions which appear on film as bright areas would reduce the detail of adjacent areas under investigation. By using shutters plates of moderately attenuating material such as aluminum adjustments can be made to mask the less dense patient portions with aluminum to reduce their image brightness relative to the portions of interest.

It should be understood that the present disclosure is for the purpose of illustration only, and that the invention includes all modifications and equivalents falling within the appended claims.

I claim:

1. An X-ray beam controller comprising:

a first disk of X-ray opaque material rotatable about a central axis, wherein the first disk has a first X-ray window, on the axis, through the disk and has first and second tracks extending across the disk, on opposite sides of the disk, outside the window;

a first shutter means of X-ray attenuating material slidable in the first track relative to the central axis, between positions in which the first X-ray window is open and closed;

a second disk parallel to and adjacent the first disk, wherein the second disk is rotatable on the central axis relative to the first disk, and the second disk has a second X-ray window on the axis;

a second shutter means of X-ray attenuating material slidable in the second track, relative to the central axis, between positions in which the second X-ray window is open and closed;

a third disk parallel to and adjacent the first disk, wherein the third disk is rotatable on the central axis relative to the first and second disks, and the third disk has a third X-ray window on the central axis;

interengaged cam elements on the second disk and first shutter means respectively responsive to relative rotation of the disks to cam the first shutter means between open and closed positions;

interengaged cam elements on the third disk and second shutter means respectively responsive to relative rotation of the first and third disks to cam the second shutter means between open and closed positions so as to form a shaped opening on the central axis cooperatively with the first shutter means; and rotational means for relatively rotating the first, second and third disks, including first, second and third motors respectively driving the first, second and third disks, whereby rotation of the second and third disks relative to the first disk cams the first and second shutter means respectively between open and closed positions at the periphery of a generally four-sided opening on the central axis, and rotation of all three disks jointly causes orientation of the four-sided opening around the central axis.

2. A controller according to claim 1 wherein one cam element is a cam surface on one of the disks.

3. A controller according to claim 2 wherein one cam element is a projection from the shutter means to the cam surface on the other disk.

4. A controller according to claim 2 wherein the cam surface is an arcuate slot with opposed walls.

5. A controller according to claim 1 wherein the interengaging cam elements comprise a pin extending from the shutter means parallel to the central axis into a curved slot in an opposing face of the first disk.

6. A controller according to claim 1 wherein the shutter means comprise two slides fitting in the track on opposite sides of the central axis so as to form a shaped opening between the disks on the central axis.

7. A controller according to claim 2 wherein the cam surface is a curve producing a shutter movement in direct linear relation to angular rotation of the disk.

8. A controller according to claim 1 wherein the attenuating material has the property of partially reducing the energy of transmitted x-rays.

9. A controller according to claim 1 wherein the first disk has a peripheral groove, and the controller includes a base and rollers mounted on the base engaging in the groove and to support the first disk.

10. A controller according to claim 1 wherein the interengaging cam elements mechanically link the first and second disks.

11. A controller according to claim 1 wherein the first disk has a peripheral groove, and the controller includes rollers engaging in the groove and supporting the first disk.

12. An X-ray beam controller comprising:

a first disk of X-ray opaque material rotatable about a central axis, wherein the first disk has a first X-ray window, on the axis, through the disk and has first and second tracks extending across the disk, on opposite sides of the disk, outside the window;

a first shutter means of X-ray attenuating material slidable in the first track relative to the central axis, between positions in which the first X-ray window is open and closed;

a second disk parallel to and adjacent the first disk, wherein the second disk is rotatable on the central axis relative to the first disk, and the second disk has a second X-ray window on the axis;

a second shutter means of X-ray attentuating material slidable in the second track, relative to the central axis, between positions in which the second X-ray window is open and closed;

a third disk parallel to and adjacent the first disk, wherein the third disk is rotatable on the central axis relative to the first and second disks, and the third disk has a third X-ray window on the central axis;

interengaged cam elements on the second disk and first shutter means respectively responsive to relative rotation of the disks to cam the first shutter means between open and closed positions;

interengaged cam elements on the third disk and second shutter means respectively responsive to relative rotation of the first and third disks to cam the second shutter means between open and closed positions so as to form a shaped opening on the central axis cooperatively with the first shutter means; and rotational means to relatively rotate the first, second and third disks, whereby rotation of the second and third disks relative to the first disk cams the first and second shutter means respectively between open and closed positions at the periphery of the shaped opening on the central axis, and rotation of all three disks jointly causes reorientation of the shaped opening around the central axis.

13. A controller according to claim 12 wherein one cam element is a cam surface on one of the disks.

14. A controller according to claim 13 wherein one cam element is a projection from the shutter means to the cam surface on the other disk.

15. A controller according to claim 13 wherein the cam surface is an arcuate slot with opposed walls.

16. A controller according to claim 12 wherein the interengaged cam elements comprise a pin extending from the shutter means parallel to the central axis into a curved slot in an opposing face of the first disk.

17. A controller according to claim 12 wherein each shutter means comprises two slides fitting in the track on opposite sides of the central axis so as to form a shaped opening between the disks on the central axis.

18. A controller according to claim 12 wherein the first disk has a peripheral groove, and the controller includes rollers engaging in the groove and supporting the first disk.

19. A controller according to claim 12 wherein the interengaged cam elements mechanically link the first and second disks.

20. A controller according to claim 12 wherein the first disk has a peripheral groove, and the controller includes a base and rollers mounted on the base engaging in the groove and to support the first disk.

21. A controller according to claim 12 wherein the attenuating material has the property of partially reducing the energy of transmitted X-rays.

22. An X-ray beam controller comprising:

plurality of stacked disks of X-ray opaque material rotatable about a central axis, wherein a first disk of said stacked disks has a first X-ray window, on the central axis, through the first disk and has first and second tracks extending across the first disk, on opposite sides of the first disk, outside the window;

a first shutter means of X-ray attenuating material slidable in the first track relative to the central axis, between positions in which the first X-ray window is open and closed;

a second disk of said stacked disks parallel to and adjacent the first disk, wherein the second disk is rotatable on the central axis relative to the first disk, and the second disk has a second X-ray window on the central axis;

a second shutter means of X-ray attentuating material slidable in the second track, relative to the central axis, between positions in which the second X-ray window is open and closed;

interengaging cam elements on the second disk and first shutter means respectively responsive to relative rotation of the first and second disks to cam the first shutter means between open and closed positions, forming a shaped opening; and rotational means to rotate all the stacked disks, whereby relative rotation of the disks cams the first and second shutter means respectively between open and closed positions at the periphery of the shaped opening on the central axis, and rotation of all the disks jointly causes reorientation of the shaped opening around the central axis.

* * * * *